United States Patent [19]

Wernimont

[11] 4,278,857

[45] Jul. 14, 1981

[54] VIBRATION RESISTANT ELECTRICAL SWITCH

[75] Inventor: Theodore A. Wernimont, Burlington, Iowa

[73] Assignee: J. I. Case Company

[21] Appl. No.: 115,459

[22] Filed: Jan. 25, 1980

[51] Int. Cl.[3] ..... H01H 35/34

[52] U.S. Cl. ..... 200/83 R; 200/283; 200/288; 200/83 W

[58] Field of Search ..... 200/83 R, 83 W, 244, 200/246, 283, 288, 301, 81 R

[56] References Cited

U.S. PATENT DOCUMENTS

| | | | |
|---|---|---|---|
| 1,231,561 | 7/1917 | Briggs | 200/83 W |
| 3,126,466 | 3/1964 | Schwartz | 200/283 |
| 3,161,751 | 12/1964 | Pusch | 200/283 |
| 3,302,269 | 2/1967 | Cooper | 200/83 R |

*Primary Examiner*—Gerald P. Tolin

*Attorney, Agent, or Firm*—Cullen, Sloman, Cantor, Grauer, Scott & Rutherford

[57] ABSTRACT

A pressure-actuated electrical switch assembly is disclosed which includes a member for dampening the vibration experienced by the contact arm of the switch to prevent undesirable fatigue and breakage. The electrical switch is housed within a dome-like container having an entry port that is connected to a hydraulic circuit. The container is divided interiorly by a diaphragm assembly into upper and lower sealed chambers, the upper chamber having the electrical contacts for the switch and the lower chamber receiving fluid pressure through the entry port. A button actuator is fixed to the diaphragm, and it is movable vertically upward in response to fluid pressure in the lower chamber against the underside of the diaphragm which deflects the diaphragm thereby causing the button actuator to engage the cantilevered electrical contact arm which is mounted in the upper chamber. The cantilevered contact arm is bifurcated into two leg portions, a first of the leg portions being engaged by the button actuator which is attached to the diaphragm. The second leg portion extends in a cantilevered fashion above the first leg portion, and a first contact is mounted at the free end of the movable second leg portion directly above a second fixed contact. A finger-like dampening member is attached at its base and along one of its sides to a cap which encloses the upper chamber. The dampening member engages the second leg portion of the cantilevered contact arm to dampen any vibration experienced by the contact arm. In an alternate form, the dampening member is a physical stop that engages the second leg portion adjacent its free end to dampen vibration.

3 Claims, 4 Drawing Figures

VIBRATION RESISTANT ELECTRICAL SWITCH

BACKGROUND OF THE INVENTION

The present invention relates to an electrical switch assembly for actuating a warning device, and more particularly, to a means for dampening the vibration in the contact arm of the switch to prevent fatigue and breakage.

It is conventional to provide pressure-actuated electrical switches for machines such as crawler tractors which have plural hydraulic circuits for operating bulldozers and the like. The switches actuate warning devices such as lights or horns when a hydraulic line or coupling breaks or when, for whatever reason, a substantial drop in pressure occurs in a hydraulic circuit during operation.

A typical electrical switch for such machines includes a contact arm which is subjected to vibration because of the nature of the machines and the environments in which the machines work. After an extended period of use, the vibration of the machine has caused the contact arm to fatigue or break thereby necessitating repair and down time for the machine. Thus, there has been a need for an electrical switch which includes a means for dampening the vibration experienced by the contact arm to prevent undesirable fatigue and breakage.

The disadvantages of present pressure-actuated electrical switches for crawler tractors and similar machines have resulted in the electrical switch assembly of the present invention which effectively dampens vibration in the contact arm.

SUMMARY OF THE INVENTION

In accordance with the present invention, a pressure-actuated electrical switch assembly is provided for actuating a warning device in response to a substantial pressure drop in the hydraulic circuit of a crawler tractor or similar machine.

The present invention includes a pressure-actuated electrical switch which is housed within a dome-like container having an entry port that is connected to a hydraulic circuit. The container is divided interiorly by a diaphragm assembly into upper and lower sealed chambers, the upper chamber having the electrical contacts for the switch and the lower chamber receiving fluid pressure through the entry port. A button actuator is fixed to the diaphragm, and it is movable vertically upward in response to fluid pressure in the lower chamber against the underside of the diaphragm which deflects the diaphragm thereby causing the button actuator to engage a cantilevered electrical contact arm which is mounted in the upper chamber. One contact, of a pair of contacts, is mounted to the free end of the cantilevered arm.

When fluid pressure from the hydraulic circuit is present in the lower chamber, the button actuator presses upwardly on the electrical contact arm to keep the contacts out of engagement thereby opening the switch and preventing actuation of the warning device. An absence or substantial reduction of fluid pressure causes the contacts to close thereby actuating the warning device.

The movable cantilevered contact arm is bifurcated into two leg portions, a first of the leg portions being engaged by the button actuator which is attached to the diaphragm. The second leg portion is longer than the first leg portion, and it extends in a cantilevered fashion and is vertically spaced above the first leg portion. One of the contacts is mounted at the free end of the movable cantilevered second leg portion directly above the other contact which is fixed. The button actuator presses against the first leg portion to keep the contacts out of engagement when there is fluid pressure in the lower chamber of the container.

The present invention includes a finger-like dampening member which is attached at its base and along one of its sides to a cap which encloses the upper chamber. The dampening member engages the second leg portion of the cantilevered contact arm to dampen any vibration experienced by the contact arm when the contacts are open. In an alternative form, the dampening member is a physical stop that engages the second leg portion adjacent its free end to dampen vibration.

Other advantages and meritorious features of the pressure-actuated electrical switch assembly of the present invention will be more fully understood from the following detailed description of the invention, the appended claims, and the drawings, a brief description of which follows.

DETAILED DESCRIPTION OF THE INVENTION

Figure 1:
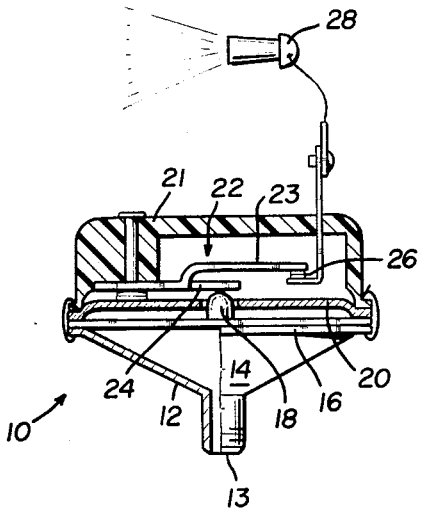
FIG. 1 is a side elevational view, partly in cross-section, of a pressure-actuated electrical switch assembly made in accordance with the present invention and illustrating the actuation of a warning device.
Figure 2:
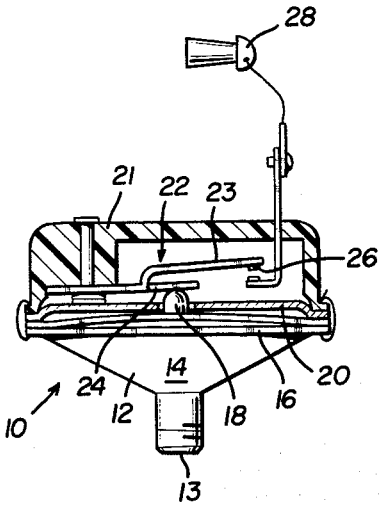
FIG. 2 is a side elevational view, partly in cross-section, of the pressure-actuated electrical switch assembly shown in FIG. 1 and illustrating the electrical contacts in their normally open position.

A pressure-actuated electrical switch assembly 10 is illustrated in FIGS. 1–2 for actuating a warning device 28. Switch assembly 10 is used in machines such as crawler tractors which have plural hydraulic circuits for operating bulldozers and the like. Warning device 28 is actuated by switch assembly 10 when a hydraulic line or coupling breaks or when, for whatever reason, a substantial drop in pressure occurs in a hydraulic circuit during operation.

The electrical switch assembly 10 includes a dome-like container having a base 12 with an entry port 13 that is hydraulically connected to one of the hydraulic circuits (not shown) of the machine. The container is divided interiorly by a diaphragm 16 into upper and lower sealed chambers, the upper chamber having electrical contacts 26 for the switch and the lower chamber 14 receiving fluid pressure through entry port 13. A button actuator 18 is fixed to diaphragm 16, and it is movable vertically upward through an opening in chamber dividing plate 20 in response to fluid pressure in the lower chamber 14 against the underside of diaphragm 16 which expands or deflects the diaphragm.

Button actuator 18 engages a cantilevered electrical contact arm 22 which is mounted in the upper chamber to non-conductive cap 21. When fluid pressure from the hydraulic circuit is present in lower chamber 14, as illustrated in FIG. 2, button actuator 18 presses upwardly on arm 22 to keep contacts 26 separated, thereby opening the switch and preventing actuation of warning device 28. An absence or substantial reduction in fluid pressure, as illustrated in FIG. 1, causes contacts 26 to close, thereby actuating warning device 28.

The cantilevered contact arm 22 is bifurcated into a short spring leg portion 24 and a long contact support leg portion 23. Spring leg portion 24 is engaged and pushed vertically upward by button actuator 18 when fluid pressure is present in lower chamber 14. Leg portion 23 extends in a cantilevered fashion and is vertically spaced above leg 24, and one of the contacts 26 is mounted to it free end directly above the other contact which is fixed. Referring to FIGS. 1 and 2, cantilevered contact arm 22, and more particularly, contact support leg 23, is subjected to vibration from the machine as previously described, and after an extended period of use, the vibration can cause the contact arm to fatigue or break.

Figure 3:
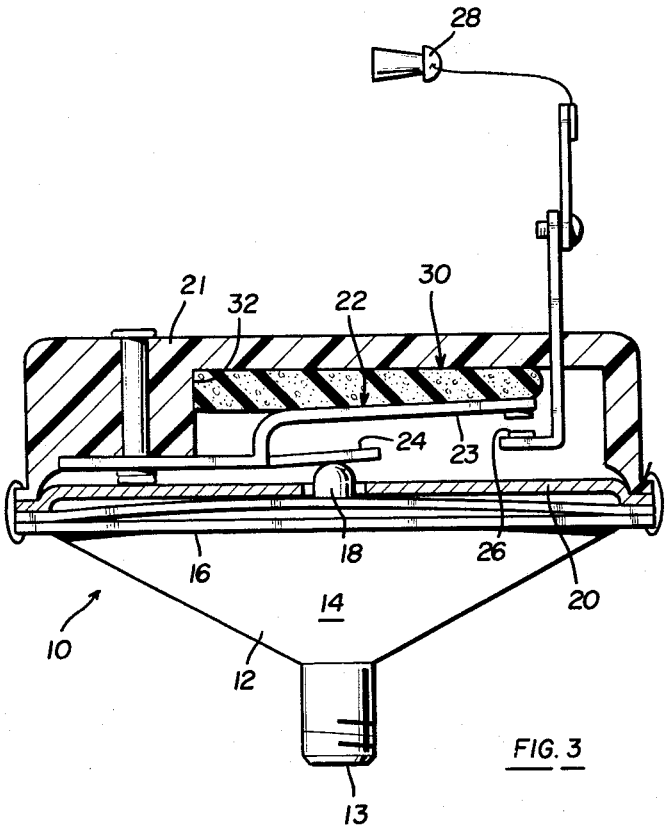
FIG. 3 is a side elevational view, partly in cross-section, of the pressure-actuated electrical switch assembly embodying the finger-like dampening member which dampens any vibration experienced by the contact arm.
Figure 4:
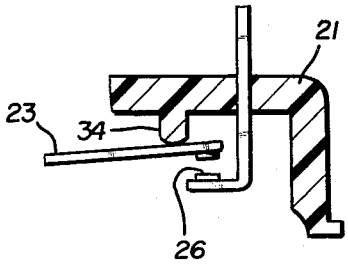
FIG. 4 is a detailed view illustrating an alternate form of the dampening member which is a physical stop that engages the contact arm adjacent its free end to dampen vibration.

The present invention, as further illustrated in FIGS. 3–4, eliminates the problem of vibration by providing, in a preferred embodiment, a finger-like dampening member 30 which is attached at its base 32 and along one of its sides to non-conductive cap 21 which encloses the upper chamber. Dampening member 30 is made of a resilient material such as foam or rubber, and it extends substantially along the entire length of leg 23 to dampen any vibration experienced by the contact arm 22 when contacts 26 are open. In an alternate form, the dampening member is a physical stop 34, as illustrated in FIG. 4, that engages leg portion 23 adjacent its free end to dampen the vibration received from the machine. The proximity of the vertically spaced leg 23 to the underside of cap 21 permits the mounting of dampening members 30 or 34 to cap 21 as opposed to other locations which further provides advantages because installation is convenient and manufacturing costs are reduced.

It will be apparent to those skilled in the art that the foregoing disclosure is examplary in nature rather than limiting, the invention being limited only by the appended claims.

I claim:

1. A pressure-actuated electrical switch assembly for actuating a warning device in response to a substantial drop in fluid pressure in a hydraulic circuit, said assembly comprising:

a dome-lime container having a base, an entry port in said base being connected to said hydraulic circuit, said container being divided interiorly by a diaphragm into upper and lower sealed chambers, said lower chamber receiving fluid pressure through said entry port;

a button actuator being fixed to one side of said diaphragm, said button actuator being movable vertically upward in response to fluid pressure in said lower chamber against a second side of said diaphragm which deflects said diaphragm;

a cap enclosing said upper chamber, a contact arm being mounted at one end to said cap, said contact arm being bifurcated into a spring leg portion and a contact support leg portion, said contact support leg portion being cantilevered and vertically spaced above said spring leg portion;

a first electrical contact being mounted at one end of said support leg portion and a second electrical contact being fixed to said cap and being aligned with said first electrical contact, said button actuator pressing upwardly on said spring leg portion in response to fluid pressure in said lower chamber to keep said contacts separated or open; and a dampening member being mounted to said cap, said dampening member engaging said contact support leg when said contacts are open to dampen any vibration experienced by said contact arm thereby preventing fatigue in said contact arm.

2. The pressure-actuated electrical switch assembly as defined in claim 1 wherein said dampening member is finger-like and said member includes a base and side portions, said member being mounted to said cap at its base and along one of its sides, said member extending substantially along the entire length of said contact support leg portion.

3. The pressure-actuated electrical switch assembly as defined in claim 1 wherein said dampening member is a physical stop which engages said contact support leg portion adjacent its one end.

* * * * *